US011682334B2

(12) United States Patent
Hong et al.

(10) Patent No.: US 11,682,334 B2
(45) Date of Patent: Jun. 20, 2023

(54) DRIVING CONTROLLER AND DISPLAY APPARATUS FOR CALCULATING CURRENT DETERIORATION DEGREE AND COMPENSATING DETERIORATION

(71) Applicant: SAMSUNG DISPLAY CO., LTD., Yongin-si (KR)

(72) Inventors: Seokha Hong, Seoul (KR); Joon-Chul Goh, Suwon-si (KR); Dongjoon Kwag, Yongin-si (KR); Jaesung Bae, Suwon-si (KR); Young-Soo Hwang, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/863,083

(22) Filed: Jul. 12, 2022

(65) Prior Publication Data

US 2023/0117828 A1 Apr. 20, 2023

(30) Foreign Application Priority Data

Oct. 18, 2021 (KR) ..... 10-2021-0138508

(51) Int. Cl.
*G09G 3/20* (2006.01)

(52) U.S. Cl.
CPC ..... *G09G 3/2007* (2013.01); *G09G 3/2096* (2013.01); *G09G 2320/0233* (2013.01); *G09G 2320/043* (2013.01); *G09G 2320/0626* (2013.01)

(58) Field of Classification Search
None
See application file for complete search history.

(56) References Cited

U.S. PATENT DOCUMENTS

| | | | | |
|---|---|---|---|---|
| 8,804,296 | B2 | 8/2014 | Honer et al. | |
| 10,255,881 | B1 * | 4/2019 | Patel | G09G 3/20 |
| 10,395,580 | B2 | 8/2019 | Hwang | |
| 11,087,681 | B2 | 8/2021 | Park | |
| 2003/0184503 | A1 * | 10/2003 | Ohshita | G09G 3/006 345/76 |

FOREIGN PATENT DOCUMENTS

| | | | |
|---|---|---|---|
| KR | 20170030153 | A | 3/2017 |
| KR | 1020190081470 | A | 7/2017 |
| KR | 1020180050474 | A | 5/2018 |

OTHER PUBLICATIONS

Korea Search Report for Korean Patent Application No. 10-2021-0138508, filed on Oct. 18, 2021, 20 pages.

* cited by examiner

*Primary Examiner* — Chad M Dicke
(74) *Attorney, Agent, or Firm* — Cantor Colburn LLP

(57) ABSTRACT

A driving controller includes: a grayscale determiner, which determines a current grayscale of input image data, a deterioration time determiner, which determines a first deterioration time for the current grayscale corresponding to an accumulated deterioration degree, a current deterioration degree calculator, which calculates a second deterioration time by summing the first deterioration time and a calculation period, and calculates a current deterioration degree for the current grayscale according to the second deterioration time, and an image compensator, which compensates the input image data based on the current deterioration degree.

20 Claims, 8 Drawing Sheets

FIG. 4

CC:300

| DETERIORATION CURVE | | GRAYSCALE | | | | |
|---|---|---|---|---|---|---|
| | | 0 | | G1 | G2 | G3 |
| DETERIORATION TIME(s) | 0 | 1 | | 1 | 1 | 1 |
| | | | ⋮ | | | |
| | 100 | 1 | | | 0.9 (D=0.1) | |
| | 150 | 1 | | | | 0.8 (D=0.2) |
| | 300 | 1 | | 0.9 (D=0.1) | | |
| | 400 | 1 | | | 0.8 (D=0.2) | |
| | 450 | 1 | | | | 0.78 (D=0.22) |

FIG. 5

CC:300

| DETERIORATION CURVE | | GRAYSCALE | | | CG | |
|---|---|---|---|---|---|---|
| | | 0 | | G1 | G2 | G3 |
| DETERIORATION TIME(s) | 0 | 1 | | 1 | 1 | 1 |
| | | | ⋮ | | | |
| | DT1 100 | | | | 0.9 (D=0.1) | |
| | 150 | 1 | | | | 0.8 (D=0.2) |
| | 300 | 1 | AD | 0.9 (D=0.1) | CD | |
| | DT2 400 | | | | 0.8 (D=0.2) | |
| | 450 | 1 | | | | 0.78 (D=0.22) |

FIG. 7

CC:300 LD:0.2

| DETERIORATION CURVE | | GRAYSCALE | | | | CG |
|---|---|---|---|---|---|---|
| | | 0 | | G1 | G2 | G3 |
| DETERIORATION TIME(s) | 0 | 1 | | 1 | 1 | 1 |
| | | | ⋮ | | | |
| | 100 | 1 | | | 0.9 (D=0.1) | |
| DT1 | 150 | 1 | | | | 0.8 (D=0.2) |
| | 300 | 1 | | 0.9 (D=0.1) | | |
| | 400 | 1 | | AD | 0.8 (D=0.2) | CD |
| DT2 | 450 | 1 | | | | 0.78 (D=0.22) |

DRIVING CONTROLLER AND DISPLAY APPARATUS FOR CALCULATING CURRENT DETERIORATION DEGREE AND COMPENSATING DETERIORATION

This application claims to Korean Patent Application No. 10-2021-0138508, filed on Oct. 18, 2021 in the Korean Intellectual Property Office KIPO, and all the benefits accruing therefrom under 35 U.S.C. § 119, the content of which in its entirety is herein incorporated by reference.

BACKGROUND

1. Field

Embodiments of the present invention relate to a display apparatus. More particularly, embodiments of the present invention relate to a driving controller compensating deterioration and a display apparatus including the driving controller.

2. Description of the Related Art

Generally, a display apparatus may include a display panel, a driving controller, a gate driver, and a data driver. The display panel may include a plurality of gate lines, a plurality of data lines, and a plurality of pixels electrically connected to the gate lines and the data lines. The gate driver may provide gate signals to the gate lines. The data driver may provide data voltages to the data lines. The driving controller may control the gate driver and the data driver.

In the pixels, deterioration in which a threshold voltage and/or an electron mobility characteristic change as a driving time (or a deterioration time) increases. As the driving time of the pixels increases, the deterioration increases. Even when the same data voltage is applied to the pixels, the luminance of the pixels may be decreased due to the deterioration.

SUMMARY

Embodiments of the present invention provide a driving controller that compensates deterioration of pixels having different deterioration characteristics for each grayscales.

Embodiments of the present invention also provide a display apparatus that compensates deterioration of pixels having different deterioration characteristics for each grayscales.

According to embodiments of the present invention, a driving controller includes: a grayscale determiner, which determines a current grayscale of input image data; a deterioration time determiner, which determines a first deterioration time for the current grayscale corresponding to an accumulated deterioration degree; a current deterioration degree calculator, which calculates a second deterioration time by summing the first deterioration time and a calculation period; and calculates a current deterioration degree for the current grayscale according to the second deterioration time, and an image compensator, which compensates the input image data based on the current deterioration degree.

In an embodiment, the calculation period may have various values, and the current deterioration degree calculator may be configured to calculate the current deterioration degree for each the calculation period, and the accumulated deterioration degree may be updated to the current deterioration degree for each of the various values of the calculation period.

In an embodiment, the calculation period may include a plurality of frames.

In an embodiment, the deterioration time determiner may be configured to receive deterioration curves for respective grayscales and to determine the first deterioration time for the current grayscale corresponding to the accumulated deterioration degree based on a deterioration curve for the current grayscale among the received deterioration curves.

In an embodiment, the current deterioration degree calculator may be configured to receive the deterioration curves for the respective grayscales, and to calculate the current deterioration degree for the current grayscale according to the second deterioration time based on the deterioration curve for the current grayscale.

In an embodiment, the deterioration curves may include information on a deterioration degree for each of the grayscales according to a deterioration time.

In an embodiment, the deterioration curves may be different according to the grayscales.

In an embodiment, the deterioration curve for the current grayscale may be generated using an equation $$1 - D = e^{S \times (DT \times (L/Lref)^{Acc}) \times C)^{\frac{1}{T}}},$$

where D is the deterioration degree, S is a fitting parameter, C is a temperature parameter, DT is the deterioration time, L is a luminance according to a grayscale, Lref is a reference luminance, Acc is an acceleration parameter, and T is a deterioration curvature.

In an embodiment, the image compensator may be configured to compensate the input image data based on a preset threshold deterioration degree when the current deterioration degree is greater than the threshold deterioration degree.

According to embodiments of the present invention, a display apparatus includes: a display panel including pixels; a driving controller, which determines a first deterioration time for a current grayscale of input image data corresponding to an accumulated deterioration degree, calculates a second deterioration time by summing the first deterioration time and a calculation period, and calculates a current deterioration degree for the current grayscale according to the second deterioration time, and compensates the input image data based on the current deterioration degree to generate output image data; and a data driver, which generate data voltages based on the output image data and applies the data voltages to the pixels.

In an embodiment, the calculation period may have various values, and the driving controller may be configured to calculate the current deterioration degree for each of the various values of the calculation period.

In an embodiment, the calculation period may include a plurality of frames.

In an embodiment, the display apparatus may further include a memory device, which stores deterioration curves for respective grayscales, and the deterioration curves may include information on a deterioration degree for each of the grayscales according to a deterioration time.

In an embodiment, the driving controller may be configured to determine the first deterioration time for the current grayscale corresponding to the accumulated deterioration degree based on a deterioration curve for the current grayscale among the deterioration curves.

In an embodiment, the driving controller may be configured to calculate the current deterioration degree for the current grayscale according to the second deterioration time based on the deterioration curve for the current grayscale.

In an embodiment, the deterioration curves may be different according to the grayscales.

In an embodiment, the deterioration curve for the current grayscale may be generated using an equation $$1 - D = e^{S \times (DT \times (L/Lref)^{Acc}) \times C)^{\frac{1}{T}}},$$

where D is the deterioration degree, S is a fitting parameter, C is a temperature parameter, DT is the deterioration time, L is a luminance according to a grayscale, Lref is a reference luminance, Acc is an acceleration parameter, and T is a deterioration curvature.

In an embodiment, the memory device store the accumulated deterioration degree, the accumulated deterioration degree stored in the memory device may be updated to the current deterioration degree.

In an embodiment, the driving controller may be configured to compensate the input image data based on a preset threshold deterioration degree when the current deterioration degree is greater than the threshold deterioration degree.

In an embodiment, the driving controller may not calculate the current deterioration degree but compensate the input image data based on the threshold deterioration degree when the accumulated deterioration degree is greater than the threshold deterioration degree.

Therefore, the display apparatus may appropriately compensate deterioration according to the grayscales by storing and using deterioration curves for respective grayscales.

In addition, the display apparatus may constantly compensate deterioration regardless of the order in which grayscales change (e.g., the deterioration is compensated equally when changing from 0 to 255 grayscale and from 255 to 0 grayscale.) by calculating a deterioration time for the current grayscale corresponding to an accumulated deterioration degree.

However, the effects of the present invention are not limited to the above-described effects, and may be variously expanded without departing from the spirit and scope of the present invention.

BRIEF DESCRIPTION OF THE DRAWINGS

FIG. 4 is a table illustrating a lookup table of the deterioration curves of FIG. 3.

FIG. 5 is a table illustrating an example in which the display apparatus of FIG. 1 calculates a current deterioration degree.

FIG. 7 is a table illustrating an example in which the display apparatus of FIG. 6 calculates a current deterioration degree.

DETAILED DESCRIPTION

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Hereinafter, the present invention will be explained in detail with reference to the accompanying drawings.

Figure 1:
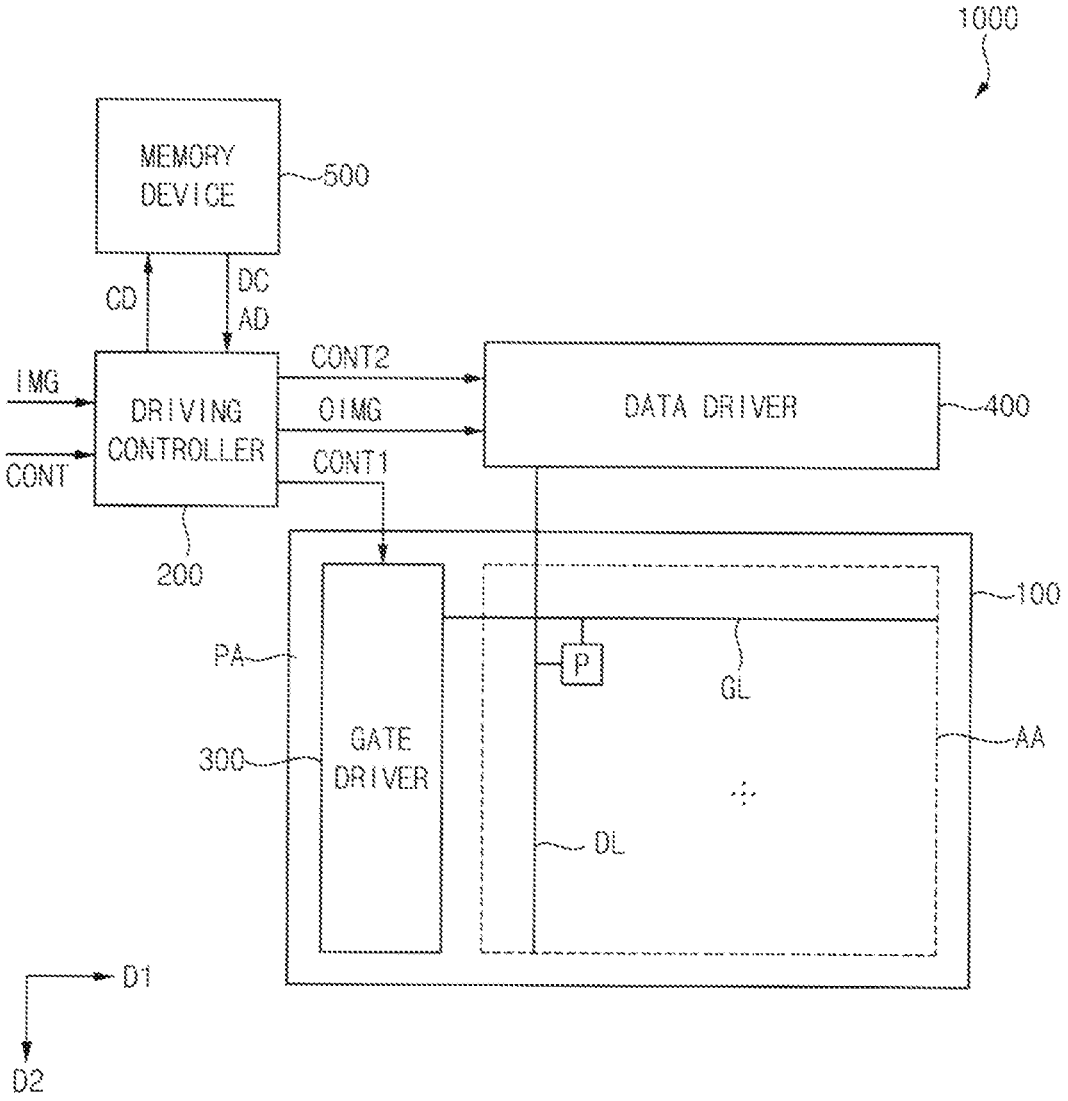
FIG. 1 is a block diagram illustrating a display apparatus according to embodiments of the present invention.

FIG. 1 is a block diagram illustrating a display apparatus 1000 according to embodiments of the present invention.

Referring to FIG. 1, the display apparatus 1000 may include a display panel 100, a driving controller 200, a gate driver 300, a data driver 400, and a memory device 500. According to an embodiment, the driving controller 200 and the data driver 400 may be integrated into one chip. For example, the memory device 500 may be a nonvolatile memory apparatus.

The display panel 100 has a display region AA on which an image is displayed and a peripheral region PA adjacent to the display region AA. According to an embodiment, the gate driver 300 may be integrated on the peripheral region PA of the display panel 100.

The display panel 100 may include a plurality of gate lines GL, a plurality of data lines DL, and a plurality of pixels P electrically connected to the data lines DL and the gate lines GL. The gate lines GL may extend in a first direction D1 and the data lines DL may extend in a second direction D2 crossing the first direction D1.

The driving controller 200 may receive input image data IMG and an input control signal CONT from an external device (e.g., a graphic processing unit; GPU). For example, the input image data IMG may include red image data, green image data and blue image data. According to an embodiment, the input image data IMG may further include white image data. For another example, the input image data IMG may include magenta image data, yellow image data, and cyan image data. The input control signal CONT may include a master clock signal and a data enable signal. The input control signal CONT may further include a vertical synchronizing signal and a horizontal synchronizing signal.

The driving controller 200 may generate a first control signal CONT1, a second control signal CONT2, a current deterioration degree CD, and output image data OIMG based on the input image data IMG, the input control signal CONT, an accumulated deterioration degree AD, and deterioration curves DC for grayscales.

The driving controller 200 may generate the first control signal CONT1 for controlling operation of the gate driver 300 based on the input control signal CONT and output the first control signal CONT1 to the gate driver 300. The first control signal CONT1 may include a vertical start signal and a gate clock signal.

The driving controller 200 may generate the second control signal CONT2 for controlling operation of the data driver 400 based on the input control signal CONT and output the second control signal CONT2 to the data driver 400. The second control signal CONT2 may include a horizontal start signal and a load signal.

The driving controller 200 may receive the input image data IMG and the input control signal CONT from the external device, and receive the accumulated deterioration degree AD and the deterioration curves DC from the memory device 500, and generate the output image data OIMG based on the received data and signals (e.g., IMG, CONT, AD, DC). The driving controller 200 may output the output image data OIMG to the data driver 400.

The driving controller 200 may receive the input image data IMG, the accumulated deterioration degree AD, and the deterioration curves DC, and generate the current deterioration degree CD based on the input image data IMG, the accumulated deterioration degree AD, and the deterioration curves DC. The driving controller 200 may output the current deterioration degree CD to the memory device 500.

The gate driver 300 may generate gate signals for driving the gate lines GL in response to the first control signal CONT1 input from the driving controller 200. The gate driver 300 may output the gate signals to the gate lines GL. For example, the gate driver 300 may sequentially output the gate signals to the gate lines GL.

The data driver 400 may receive the second control signal CONT2 and the output image data OIMG from the driving controller 200. The data driver 400 may convert the output image data OIMG into data voltages having an analog type. The data driver 400 may output the data voltage to the data lines DL.

The memory device 500 may store the accumulated deterioration degree AD and the deterioration curves DC. The memory device 500 may receive the current deterioration degree CD from the driving controller 200. The accumulated deterioration degree AD stored in the memory device 500 may be updated to the current deterioration degree CD (i.e., the value of the accumulated deterioration degree AD may be changed to the value of the current deterioration degree CD).

Figure 2:
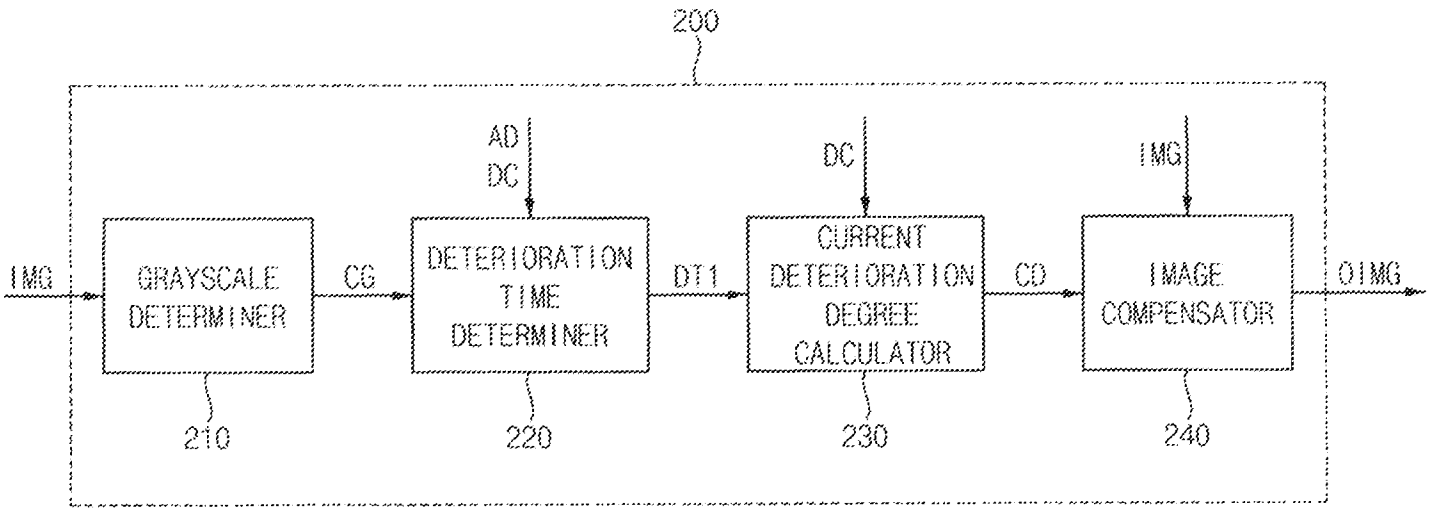
FIG. 2 is a block diagram illustrating an example of a driving controller of the display apparatus of FIG. 1.
Figure 3:
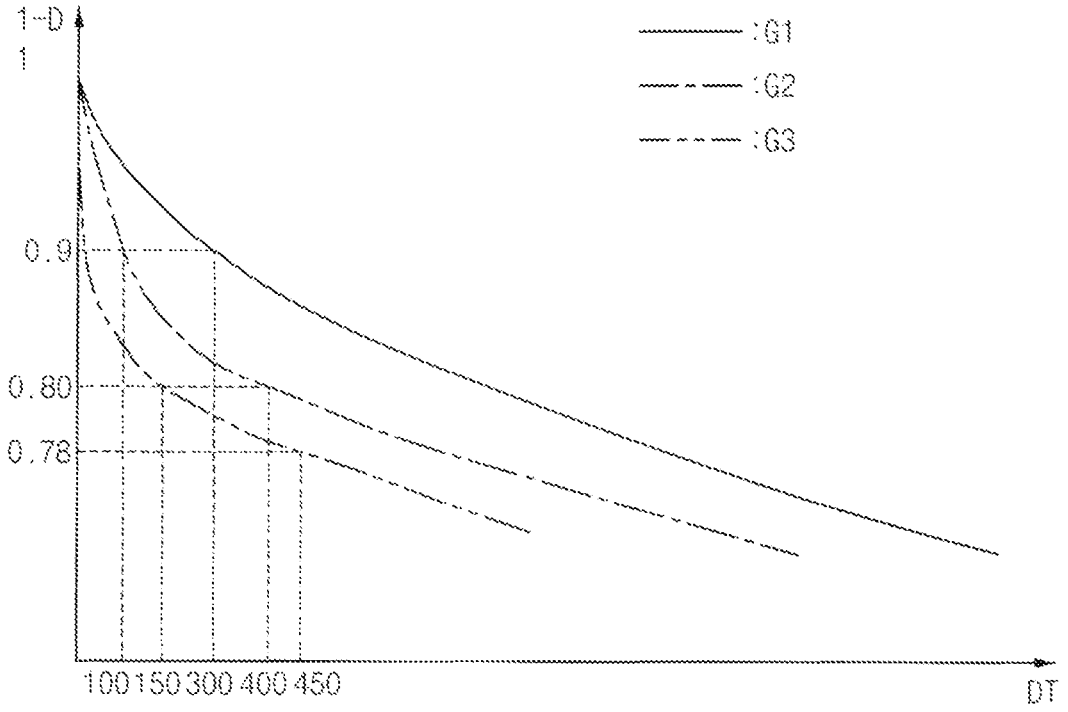
FIG. 3 is a graph illustrating an example of deterioration curves stored in the display apparatus of FIG. 1.

FIG. 2 is a block diagram illustrating an example of the driving controller 200 of the display apparatus 1000 of FIG. 1, FIG. 3 is a graph illustrating an example of the deterioration curves DC stored in the display apparatus 1000 of FIG. 1, FIG. 4 is a table illustrating a lookup table of the deterioration curves DC of FIG. 3, and FIG. 5 is a table illustrating an example in which the display apparatus 1000 of FIG. 1 calculates the current deterioration degree CD.

Referring to FIGS. 2 to 5, the driving controller 200 may determine a first deterioration time DT1 for a current grayscale CG of the input image data IMG corresponding to the accumulated deterioration degree AD, calculate a second deterioration time DT2 by summing the first deterioration time DT1 and a calculation period CC, and calculate the current deterioration degree CD for the current grayscale CG according to the second deterioration time DT2, and compensate the input image data IMG based on the current deterioration degree CD to generate the output image data OIMG.

The driving controller 200 may include a grayscale determiner 210, a deterioration time determiner 220, a current deterioration degree calculator 230, and an image compensator 240.

The grayscale determiner 210 may receive the input image data IMG and determine the current grayscale CG of the input image data IMG. The grayscale determiner 210 may output the current grayscale CG to the deterioration time determiner 220.

The deterioration time determiner 220 may receive the accumulated deterioration degree AD and the current grayscale CG, and determine the first deterioration time DT1 for the current grayscale CG corresponding to the accumulated deterioration degree AD.

The accumulated deterioration degree AD may be a value obtained by continuously accumulating a deterioration degree D. The accumulated deterioration degree AD may be updated to the current deterioration degree CD whenever the current deterioration degree CD is calculated (i.e., the value of the accumulated deterioration degree AD may be changed to the value of the current deterioration degree CD). Accordingly, the accumulated deterioration degree AD may be the current deterioration degree CD of the pixels P of the display apparatus 1000 when the accumulated deterioration degree AD is updated (i.e., the deterioration degree D accumulated in the pixels P from when the pixels P are driven until the accumulated deterioration degree AD is updated.).

The deterioration time determiner 220 may receive the deterioration curves DC for the respective grayscales and determine the first deterioration time DT1 for the current grayscale CG of the input image data IMG corresponding to the accumulated deterioration degree AD based on the deterioration curve for the current grayscale CG.

The deterioration curves DC may include information on the deterioration degree D for each of the grayscales according to the deterioration time DT. For example, when the display apparatus 1000 represents grayscales from 0 to 255 grayscales, the number of the deterioration curves DC may be 256. The deterioration curves DC may be different according to the grayscales. The deterioration curves DC may include information on the deterioration degree D when the pixels P are driven with a specific grayscale for a specific deterioration time DT. For example, as shown in FIG. 3, the deterioration curves DC may indicate the deterioration degree D according to the deterioration time DT. The deterioration degree D may be 0 (i.e., 1-D is 1) when the deterioration time DT is 0. The deterioration degree D may increase as the deterioration time DT increases when the grayscale is not 0.

The deterioration curve DC may be generated using an equation $$1 - D = e^{S \times (DT \times (L/Lref)^{Acc}) \times C)^{\frac{1}{T}}},$$

where D is the deterioration degree, S is a fitting parameter, C is a temperature parameter, DT is the deterioration time, L is a luminance according to a grayscale, Lref is a reference luminance, Acc is an acceleration parameter, and T is a deterioration curvature. The fitting parameter S may be a proportional constant and may have a fixed value regardless of a grayscale. The temperature parameter C may increase as a surface temperature of the pixels P increases. The luminance L according to the grayscale may be a luminance displaying each of the grayscales determined by a gamma characteristic or the like. The reference luminance Lref may be a luminance displaying a white grayscale (i.e., a grayscale for displaying the highest luminance). The acceleration parameter Acc may be a parameter for correcting a deterioration rate according to the luminance because the deterioration rate does not increase in direct proportion as the luminance increases. The deterioration curvature T may vary according to a material of a light emitting element of the pixels P. For example, the deterioration curvature T may have a different value according to the degree to which the deterioration degree D of the material changes. Since the deterioration curves DC are different for the grayscales, the deterioration degree D (i.e., the degree of change in a threshold voltage and/or an electron mobility characteristic) may vary according to the grayscale.

The first deterioration time DT1 may mean the deterioration time DT for the current grayscale CG corresponding to the accumulated deterioration degree AD. For example, the first deterioration time DT1 may be the amount of time taken to reach the deterioration degree D equal to the accumulated deterioration degree AD when the pixels P are initially driven with the current grayscale CG.

The current deterioration degree calculator 230 may calculate a second deterioration time DT2 by summing the first deterioration time DT1 and the calculation period CC, and calculate the current deterioration degree CD for the current grayscale CG according to the second deterioration time DT2.

The calculation period CC may be the same as the deterioration time DT from when the accumulated deterioration degree AD is updated until the current deterioration degree CD is calculated. The current deterioration degree calculator 230 may calculate the current deterioration degree CD for each calculation period CC. That is, the current deterioration degree CD may be determined by accumulating the deterioration degree D to the accumulated deterioration degree AD during the calculation period CC. According to an embodiment, the calculation period CC may include a plurality of frames. Accordingly, the display apparatus 1000 may calculate the deterioration degree D for each of a plurality of frames.

The current deterioration degree calculator 230 may receive the deterioration curves DC for the respective grayscales, and calculate the current deterioration degree CD for the current grayscale CG according to the second deterioration time DT2 based on the deterioration curve DC for the current grayscale CG. The current deterioration degree CD may be the same as the accumulated degree of the deterioration degree D when the pixels P are driven during the second deterioration time DT2. When the grayscale is changed, the display apparatus 1000 may calculate the current deterioration degree CD using the deterioration curve DC for the changed grayscale. Since each of grayscales has a different deterioration curve DC, the deterioration degree D may vary according to the deterioration order. In other words, the deterioration degree D may be different when changed from 255 grayscale to 192 grayscale and when changed from 192 grayscale to 255 grayscale. However, since the display apparatus 1000 uses the deterioration curve DC for the changed grayscale when the grayscale is changed, the current deterioration degree CD may be calculated regardless of the deterioration order (i.e., the current deterioration degree CD may be the same when changed from 255 grayscale to 192 grayscale and when changed from 192 grayscale to 255 grayscale.).

The image compensator 240 may receive the current deterioration degree CD and compensate the input image data IMG based on the current deterioration degree CD. In the pixels P, the threshold voltage and/or the electron mobility characteristic may be changed according to the deterioration degree D, and thus luminance may be lowered. As the deterioration degree D increases, the luminance of the pixels P may decrease. Accordingly, the image compensator 240 may compensate the reduced luminance by increasing the grayscale of the input image data IMG as the current deterioration degree CD increases.

Referring to FIGS. 3 to 5, it is assumed that a first grayscale G1 is smaller than a second grayscale G2, and the second grayscale G2 is smaller than a third grayscale G3. The deterioration curves DC may be different according to each of the grayscales. For example, the deterioration degree D may be greater for a higher grayscale during the same deterioration time DT. For example, during the same deterioration time DT, the deterioration degree D of the first grayscale G1 may be smaller than the deterioration degree D of the second grayscale G2. For example, during the same deterioration time DT, the deterioration degree D of the second grayscale G2 may be smaller than the deterioration degree D of the third grayscale G3. In the deterioration curves DC, the deterioration degree D may be 0 when the deterioration time DT is 0. In the deterioration curves DC, the deterioration degree D may increase as the deterioration time DT increases.

The deterioration time determiner 220 may receive the deterioration curves DC for the respective grayscales, and determine the first deterioration time DT for the current grayscale CG corresponding to the accumulated deterioration degree AD based on the deterioration curve DC for the current grayscale CG. The current deterioration degree calculator 230 may calculate the second deterioration time DT2 by summing the first deterioration time DT1 and the calculation period CC. The current deterioration degree calculator 230 may calculate the current deterioration degree CD for the current grayscale CG according to the second deterioration time DT2 based on the deterioration curve DC for the current grayscale CG. For example, it is assumed that a previous grayscale (i.e., the grayscale prior to the calculation period CC) is the first grayscale G1, the accumulated deterioration degree AD (i.e., the current deterioration degree CD calculated prior to the calculation period CC) is 0.1, the current grayscale CG is the second grayscale G2, and the calculation period CC is 300 s (Here, "s" means a unit time). The deterioration time determiner 220 may determine the first deterioration time DT1 for the second grayscale G2 of the input image data IMG corresponding to the accumulated deterioration degree AD based on the deterioration curve DC for the second grayscale G2. As shown in the deterioration curve DC for the second grayscale G2, when the deterioration degree D is 0.1 (because the accumulated deterioration degree AD is 0.1), the deterioration time DT for the second grayscale G2 may be 100 s. Accordingly, the first deterioration time DT1 for the second grayscale G2 corresponding to the accumulated deterioration degree AD may be 100 s. The current deterioration degree calculator 230 may calculate the second deterioration time DT2 by summing 100*s* and 300*s* (because the calculation period CC is 300 s). Accordingly, the second deterioration time DT2 may be 400 s. The current deterioration degree calculator 230 may calculate the current deterioration degree CD according to the second deterioration time DT2 using the deterioration curve DC for the second grayscale G2. As shown in the deterioration curve DC for the second grayscale G2, when the deterioration time DT is 400 s (because the second deterioration time DT2 is 400 s), the deterioration degree D for the second grayscale G2 may be 0.2. Accordingly, the current deterioration degree CD may be 0.2.

Figure 6:
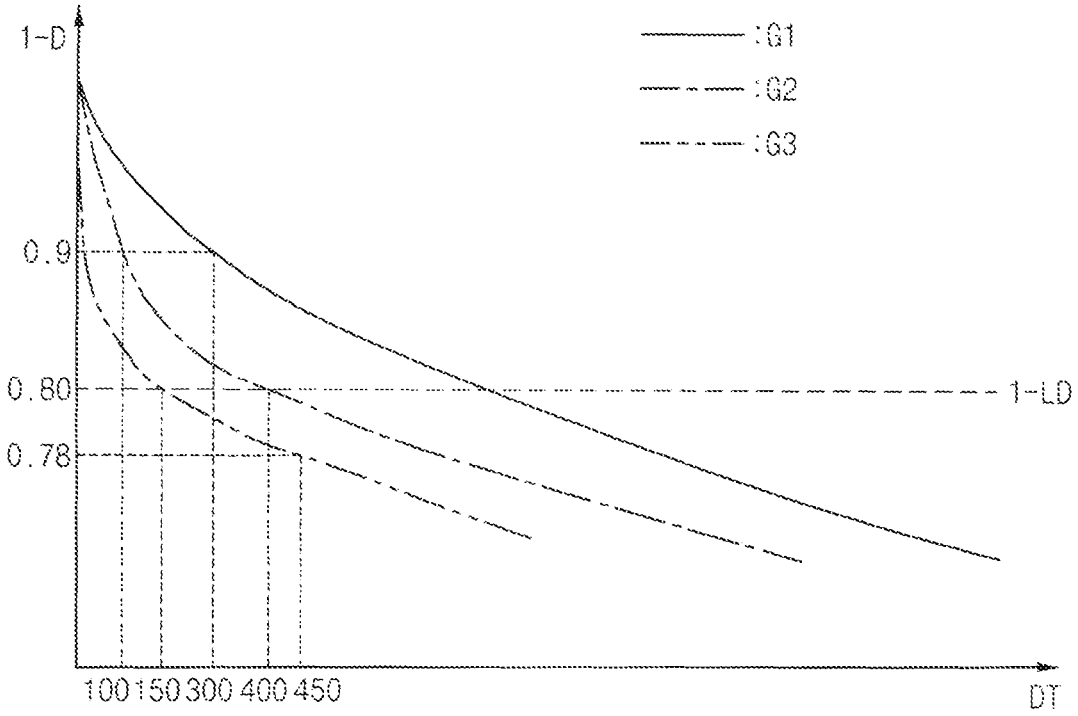
FIG. 6 is a graph for explaining an example in which a display apparatus according to embodiments of the present invention calculates a current deterioration degree.

FIG. 6 is a graph for explaining an example in which a display apparatus according to embodiments of the present invention calculates the current deterioration degree CD, and FIG. 7 is a table illustrating an example in which the display apparatus of FIG. 6 calculates the current deterioration degree CD.

The display apparatus according to the present embodiment is substantially the same as the display apparatus 1000 of FIG. 1 except for calculating the current deterioration degree CD. Thus, the same reference numerals are used to refer to the same or similar element, and any repetitive explanation will be omitted.

Referring to FIGS. 6 and 7, the driving controller 200 may compensate the input image data IMG based on a preset threshold deterioration degree LD when the current deterioration degree CD is greater than the threshold deterioration degree LD. The image compensator 240 may compensate the input image data IMG based on a preset threshold deterioration degree LD when the current deterioration degree CD is greater than the threshold deterioration degree LD. For example, it is assumed that a previous grayscale (i.e., the grayscale prior to the calculation period CC) is the second grayscale G2, the accumulated deterioration degree AD (i.e., the current deterioration degree CD calculated prior to the calculation period CC) is 0.2, the current grayscale CG is the third grayscale G3, the calculation period CC is 300 s, and the threshold deterioration degree LD is 0.2. The deterioration time determiner 220 may determine the first deterioration time DT1 for the third grayscale G3 of the input image data IMG corresponding to the accumulated deterioration degree AD based on the deterioration curve DC for the third grayscale G3. As shown in the deterioration curve DC for the third grayscale G3, when the deterioration degree D is 0.2 (because the accumulated deterioration degree AD is 0.2), the deterioration time DT for the third grayscale G3 may be 150 s. Accordingly, the first deterioration time DT1 for the third grayscale G3 corresponding to the accumulated deterioration degree AD may be 150 s. The current deterioration degree calculator 230 may calculate the second deterioration time DT2 by summing 150*s* and 300*s* (because the calculation period CC is 300 s). Accordingly, the second deterioration time DT2 may be 450 s. The current deterioration degree calculator 230 may calculate the current deterioration degree CD according to the second deterioration time DT2 using the deterioration curve DC for the third gray scale G3. As shown in the deterioration curve DC for the third grayscale G3, when the deterioration time DT is 450 s (because the second deterioration time DT2 is 450 s), the deterioration degree D for the third grayscale G3 may be 0.22. Since the current deterioration degree CD is greater than the threshold deterioration degree LD (the current deterioration degree CD is 0.22 and the deterioration degree LD is 0.2), the image compensator 240 may compensate the input image data IMG based on the threshold deterioration degree LD. For example, when the threshold deterioration degree LD is 0.2, the image compensator 240 may compensate the input image data IMG in the same manner as when the current deterioration degree CD is 0.2. The compensation of the input image data IMG may be performed by increasing the grayscale of the input image data IMG.

Figure 8:
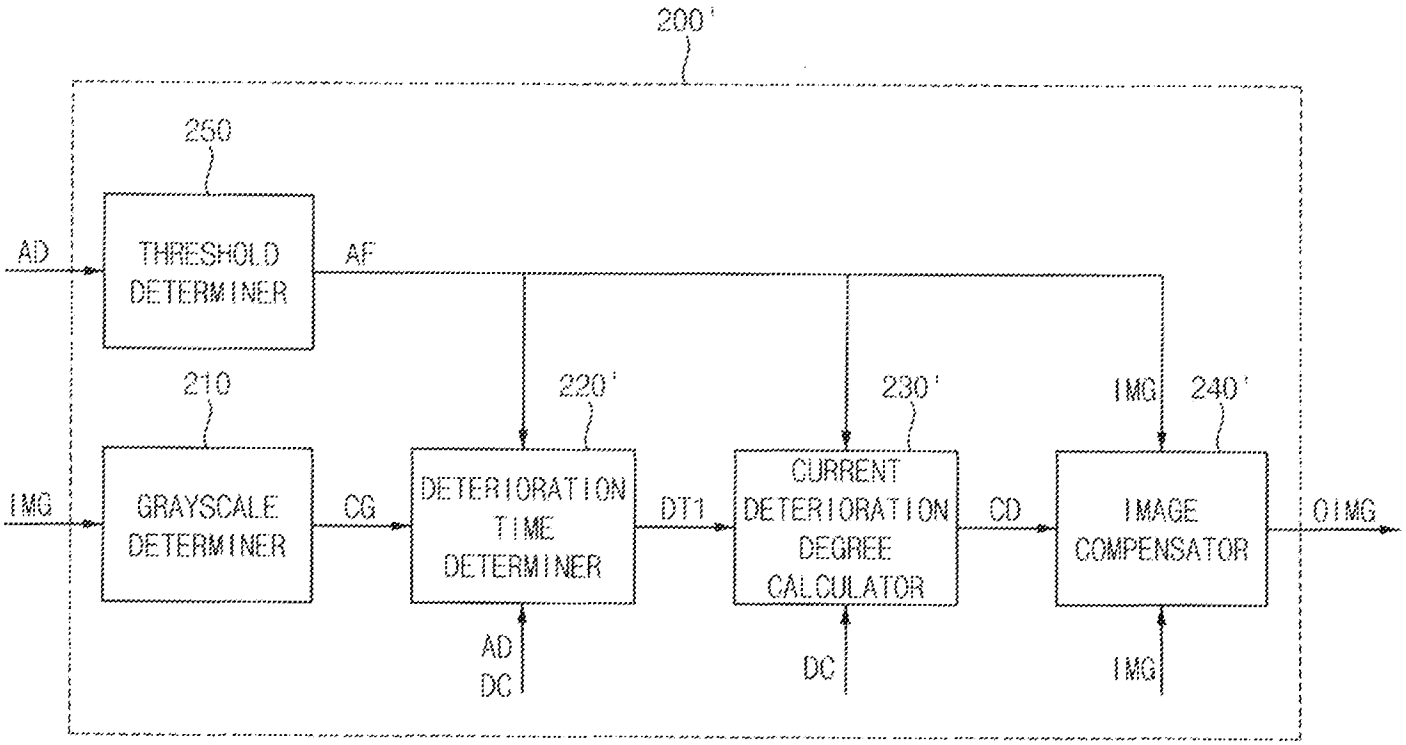
FIG. 8 is a block diagram illustrating a driving controller of a display apparatus according to embodiments of the present invention.

FIG. 8 is a block diagram illustrating a driving controller 200' of a display apparatus according to embodiments of the present invention.

The display apparatus according to the present embodiment is substantially the same as the display apparatus 1000 of FIG. 1 except for the driving controller 200'. Thus, the same reference numerals are used to refer to the same or similar element, and any repetitive explanation will be omitted.

Referring to FIG. 8, the driving controller 200' may determine the first deterioration time DT1 for the current grayscale CG of the input image data IMG corresponding to the accumulated deterioration degree AD, calculate the second deterioration time DT2 by summing the first deterioration time DT1 and the calculation period CC, and calculate the current deterioration degree CD for the current grayscale CG according to the second deterioration time DT2, and compensate the input image data IMG based on the current deterioration degree CD to generate the output image data OIMG. The driving controller 200' may compensate the input image data IMG based on the threshold deterioration degree LD when the current deterioration degree CD is greater than the threshold deterioration degree LD. The image compensator 240 may compensate the input image data IMG based on a preset threshold deterioration degree LD when the current deterioration degree CD is greater than the threshold deterioration degree LD. The driving controller 200' may not calculate the current deterioration degree CD but compensate the input image data IMG based on the threshold deterioration degree LD when the accumulated deterioration degree AD is greater than the threshold deterioration degree LD.

The driving controller 200' may include the grayscale determiner 210, a deterioration time determiner 220', a current deterioration degree calculator 230', an image compensator 240', and a threshold determiner 250.

The grayscale determiner 210 may receive the input image data IMG and determine the current grayscale CG of the input image data IMG. The grayscale determiner 210 may output the current grayscale CG to the deterioration time determiner 220'.

The threshold determiner 250 may receive the accumulated deterioration degree AD, compare the accumulated deterioration degree AD with the threshold deterioration degree LD, and not output an activation signal AF to the deterioration time determiner 220', the current deterioration degree calculator 230', and the image compensator 240' when the accumulated deterioration degree AD is greater than the threshold deterioration degree LD. The threshold determiner 250 may receive the accumulated deterioration degree AD, compare the accumulated deterioration degree AD with the threshold deterioration degree LD, and output the activation signal AF to the deterioration time determiner 220', the current deterioration degree calculator 230', and the image compensator 240' when the accumulated deterioration degree AD is less than or equal to the threshold deterioration degree LD.

The deterioration time determiner 220' may determine the first deterioration time DT1 for the current grayscale CG corresponding to the accumulated deterioration degree AD in response to the activation signal AF. For example, the deterioration time determiner 220' may determine the first deterioration time DT1 when the activation signal AF is received, and not determine the first deterioration time DT1 when the activation signal AF is not received.

The current deterioration degree calculator 230' may calculate the second deterioration time DT2 in response to the activation signal AF, and calculate the current deterioration degree CD for the current grayscale CG according to the second deterioration time DT2 in response to the activation signal AF. For example, the current deterioration degree calculator 230' may calculate the second degradation time DT2 and the current deterioration degree CD when the activation signal AF is received, and not calculate the second degradation time DT2 and the current deterioration degree CD when the activation signal AF is not received.

The image compensator 240' may compensate the input image data IMG in response to the activation signal AF. For example, the image compensator 240' may compensate the input image data IMG based on the current deterioration degree CD when the activation signal AF is received, and not compensate the input image data IMG based on the current deterioration degree CD when the activation signal AF is not received.

Accordingly, when the current deterioration degree CD is greater than the threshold deterioration degree LD, the display apparatus according to the present invention may not calculate the current deterioration degree CD but compensate the input image data IMG based on the threshold deterioration degree LD.

The inventions may be applied to any electronic apparatus including the display apparatus. For example, the inventions may be applied to a television ("TV"), a digital TV, a 3D TV, a mobile phone, a smart phone, a tablet computer, a virtual reality ("VR") apparatus, a wearable electronic apparatus, a personal computer ("PC"), a home appliance, a laptop computer, a personal digital assistant ("PDA"), a portable multimedia player ("PMP"), a digital camera, a music player, a portable game console, a navigation apparatus, etc.

As used in connection with various embodiments of the disclosure, the grayscale determiner 210, the deterioration time determiner 220, the current deterioration degree calculator 230, and the image compensator 240 may be implemented in hardware, software, firmware, or in a form of an application-specific integrated circuit (ASIC).

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A driving controller comprising:

a grayscale determiner, which determines a current grayscale of input image data;

a deterioration time determiner, which determines a first deterioration time for the current grayscale corresponding to an accumulated deterioration degree;

a current deterioration degree calculator, which calculates a second deterioration time by summing the first deterioration time and a calculation period, and calculates a current deterioration degree for the current grayscale according to the second deterioration time; and an image compensator, which compensates the input image data based on the current deterioration degree.

2. The driving controller of claim 1, wherein the calculation period has various values, and the current deterioration degree calculator is configured to calculate the current deterioration degree for each of the various values of the calculation period, and wherein the accumulated deterioration degree is updated to the current deterioration degree for each of the various values of the calculation period.

3. The driving controller of claim 1, wherein the calculation period includes a plurality of frames.

4. The driving controller of claim 1, wherein the deterioration time determiner is configured to receive deterioration curves for respective grayscales and to determine the first deterioration time for the current grayscale corresponding to the accumulated deterioration degree based on a deterioration curve for the current grayscale among the received deterioration curves.

5. The driving controller of claim 4, wherein the current deterioration degree calculator is configured to receive the deterioration curves for the respective grayscales, and to calculate the current deterioration degree for the current grayscale according to the second deterioration time based on the deterioration curve for the current grayscale.

6. The driving controller of claim 5, wherein the deterioration curves include information on a deterioration degree for each of the grayscales according to a deterioration time.

7. The driving controller of claim 6, wherein the deterioration curves are different according to the grayscales.

8. The driving controller of claim 6, wherein the deterioration curve for the current grayscale is generated using an equation $$1 - D = e^{S \times (DT \times (L/Lref)^{Acc}) \times C)^{\frac{1}{T}}},$$

where D is the deterioration degree, S is a fitting parameter, C is a temperature parameter, DT is the deterioration time, L is a luminance according to a grayscale, Lref is a reference luminance, Acc is an acceleration parameter, and T is a deterioration curvature.

9. The driving controller of claim 1, wherein the image compensator is configured to compensate the input image data based on a preset threshold deterioration degree when the current deterioration degree is greater than the threshold deterioration degree.

10. A display apparatus comprising:

a display panel including pixels;

a driving controller, which determine a first deterioration time for a current grayscale of input image data corresponding to an accumulated deterioration degree, calculates a second deterioration time by summing the first deterioration time and a calculation period, calculates a current deterioration degree for the current grayscale according to the second deterioration time, and compensates the input image data based on the current deterioration degree to generate output image data; and a data driver, which generates data voltages based on the output image data and applies the data voltages to the pixels.

11. The display apparatus of claim 10, wherein the calculation period has various values, and the driving controller is configured to calculate the current deterioration degree for each of the various values of the calculation period.

12. The display apparatus of claim 10, wherein the calculation period includes a plurality of frames.

13. The display apparatus of claim 10, further comprising a memory device, which stores deterioration curves for respective grayscales, wherein the deterioration curves include information on a deterioration degree for each of the grayscales according to a deterioration time.

14. The display apparatus of claim 13, wherein the driving controller is configured to determine the first deterioration time for the current grayscale corresponding to the accumulated deterioration degree based on a deterioration curve for the current grayscale among the deterioration curves.

15. The display apparatus of claim 14, wherein the driving controller is configured to calculate the current deterioration degree for the current grayscale according to the second deterioration time based on the deterioration curve for the current grayscale.

16. The display apparatus of claim 13, wherein the deterioration curves are different according to the grayscales.

17. The display apparatus of claim 13, wherein the deterioration curve for the current grayscale is generated using an equation $$1 - D = e^{S \times (DT \times (L/Lref)^{Acc}) \times C)^{\frac{1}{T}}},$$

where D is the deterioration degree, S is a fitting parameter, C is a temperature parameter, DT is the deterioration time, L is a luminance according to a grayscale, Lref is a reference luminance, Acc is an acceleration parameter, and T is a deterioration curvature.

18. The display apparatus of claim 13, wherein the memory device stores the accumulated deterioration degree, and wherein the accumulated deterioration degree stored in the memory device is updated to the current deterioration degree.

19. The display apparatus of claim 10, wherein the driving controller is configured to compensate the input image data based on a preset threshold deterioration degree when the current deterioration degree is greater than the threshold deterioration degree.

20. The display apparatus of claim 19, wherein the driving controller does not calculate the current deterioration degree but compensates the input image data based on the threshold deterioration degree when the accumulated deterioration degree is greater than the threshold deterioration degree.

* * * * *